United States Patent [19]

Frank et al.

[11] 4,206,616

[45] Jun. 10, 1980

[54] METHOD AND CONTAINER FOR COOLING GOODS WITH DRY ICE

[75] Inventors: Martin A. Frank; Gerd Braun, both of Cologne, Fed. Rep. of Germany

[73] Assignee: Firma Kohlensaure-Werke Rud. Buse GmbH & Co., Bad Honningen, Fed. Rep. of Germany

[21] Appl. No.: 922,213

[22] Filed: Jul. 5, 1978

[51] Int. Cl.[2] ..... F25D 17/04

[52] U.S. Cl. ..... 62/406; 62/384; 62/421; 62/438

[58] Field of Search ..... 62/406, 407, 420, 421, 62/422, 438, 440, 459, 464, 465, 384, 388

[56] References Cited

U.S. PATENT DOCUMENTS

| | | | |
|---|---|---|---|
| 493,256 | 3/1893 | Dexter | 62/420 |
| 525,695 | 9/1894 | Dexter | 62/420 |
| 881,832 | 3/1908 | Sprague | 62/420 |
| 1,654,828 | 1/1928 | Nelson | 62/384 |
| 1,744,968 | 1/1930 | Keith | 62/438 |
| 1,897,095 | 2/1933 | Wooll | 62/384 |
| 1,921,147 | 8/1933 | Baird | 62/438 |
| 2,043,570 | 6/1936 | Baird | 62/438 |
| 2,088,840 | 8/1937 | Copeman | 62/384 |
| 2,966,046 | 12/1960 | Wright | 62/421 |

*Primary Examiner*—Ronald C. Capossela
*Attorney, Agent, or Firm*—Watson, Cole, Grindle & Watson

[57] ABSTRACT

The present invention relates to a container for refrigerating goods with dry ice. The container comprises an enclosed interior space subdivided by partition walls into a plurality of compartments which include one refrigerant compartment adapted to be charged with dry ice refrigerant and at least one chillroom compartment adapted for the containment of the goods to be refrigerated. The refrigerant compartment communicates with the chillroom compartment by openings which allow evaporating carbon dioxide from the dry ice to enter the chillroom compartment. The container also includes storage means of water located between the refrigerant compartment and the chillroom compartment in a sufficient quantity that at the beginning of the evaporation of the dry ice, the temperature in the chillroom compartment does not become substantially below −78° C.

Also disclosed is a method for refrigerating goods utilizing dry ice and storage means of water in the above mentioned container.

4 Claims, 2 Drawing Figures

METHOD AND CONTAINER FOR COOLING GOODS WITH DRY ICE

Figure 1:
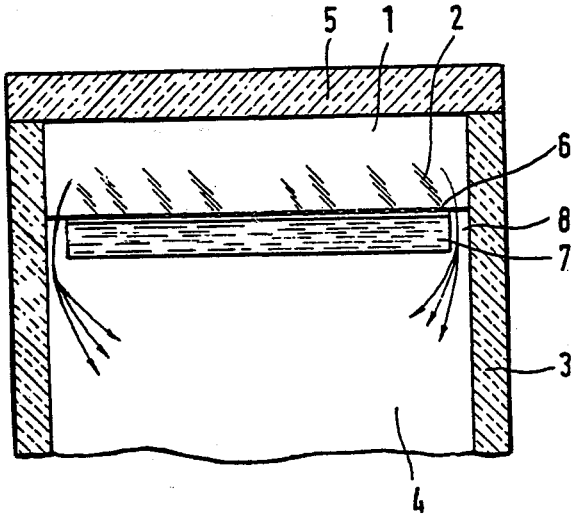

In order to cool the contents of shipping or mobile containers with thermal insulation, dry ice (solid $CO_2$), for example in the form of blocks or in the form of pellets which can be metered out more easily, is employed in order to provide a refrigerated storage and transportation means that is independent of stationary or mobile external low temperature sources.

These refrigerated containers cooled by dry ice have become known by the term "Igloo" for the shipment of fresh meat, fish and flowers, preferably in air freight traffic, and in the form of a trolley from which ready-made fresh food cooled by dry ice is offered for sale.

In the said devices, the dry ice not only provides cooling; the evolving $CO_2$ gas introduced into the chilled space forms the bacteriostatic air/carbon dioxide mixture as a protective gas suppressing the growth of microorganisms.

In designing the aforementioned devices, the difficulty has arisen to thermodynamically shield the negative source, in this case the low-temperature source, which in its own atmosphere has a sublimation temperature of 195° K. (−78° C.), against the chillroom with its chilling requirement which, in most instances, is 279° to 283° K. (6 to 10° C.) such that in the vicinity of the source of low temperature, the chilled goods will not freeze while in the more remote regions of the chillroom adequate cooling is guaranteed.

In the hitherto known and conventional designs of refrigerated containers, the difference in temperature potential between the dry ice and the chilled goods, which in the stationary state is about 86° K., is bridged by accordingly thick thermal insulation layers of a minimum heat transfer coefficient.

This constructionally determined thickness of the thermal insulation layer normally does not consider the substantially lower sublimation temperature existing in the air atmosphere after charging of the dry ice, which is about 173° K. (−100° C.) at a partial pressure $P_{CO_2}=0.12$ bar and thus creates a deep-temperature shock. In the light of the above described prior art the invention deals with the problem of influencing the chilling period by two-phase refrigeration.

According to the present invention, this object is in that the deep-temperature shock in the beginning of the refrigerating phase during build-up of the $CO_2$ atmosphere is avoided in that the cold is stored in a medium which freezes in the course of the process, and thereafter the cold is gradually released by said medium-preferably water-during the contemplated chilling period. This storage of deep temperature may also be called tandem refrigeration or two-phase refrigeration, because an additional medium is interposed in the process which gradually releases the cold to the chillroom at temperatures adapted to the existing requirements.

According to the invention, a device is proposed for carrying out the method in which a container with the liquid medium is interposed as deep temperature storage means between the chamber accommodating the refrigerant and the adjacent chillroom.

Figure 2:
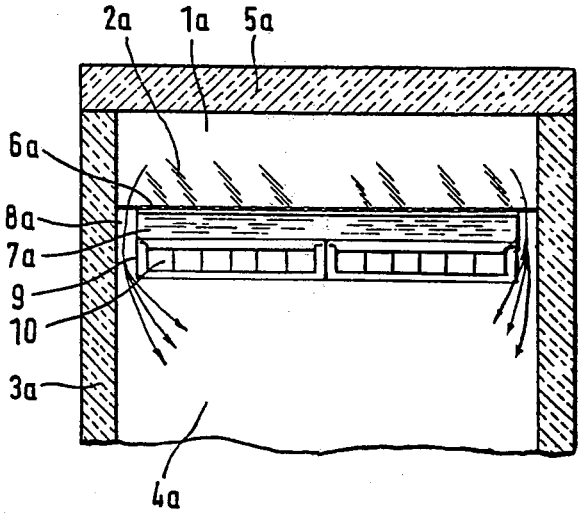

Hereafter the invention will be explained in more detail in an example with reference to the drawing in which FIG. 1 is a cross-sectional view of one embodiment according to the present invention, and FIG. 2 is a cross-sectional view of another embodiment according to the present invention.

In FIG. 1, the device comprises chamber 1 for receiving dry ice refrigerant 2. Chamber 1 consists of walls 3 with thermal insulation which, in the example, simultaneously constitute the side walls of chillroom 4, and lid 5 which may be opened to charge the device with refrigerating medium. It is also within the scope of the present invention to provide drawers for holding the refrigerant which may be inserted from the side.

Refrigerant (2) is disposed on perforated plate 6 dividing the interior of the container into the chamber 1 and the chillroom 4. Below the refrigerant there is a liquid medium in trough 7 which releases its heat, the inner energy and the solidifying heat to the dry ice.

The medium may be enclosed, for instance, in a sealed plastic container not separately shown in the drawing.

Trough (7) is designed such that there are spaces 8, slots or holes, between it and side walls 3 so that the refrigerant gas flowing through the perforated plate enters the chillroom 4 as indicated by the arrows in the drawing.

The heat of the liquid storage medium is available heat which increases the sublimation rate of the refrigerant, and thus enhances the evolution of the amount of refrigerant gas required in the chillroom especially in the initial cooling phase.

When 2 kg water of 293° K. (20° C.), for instance, are used as low-temperature storing medium, about 1.5 kg solid $CO_2$ with 545 kJ/kg (130 kcal/kg) sublimation heat use up the required heat for cooling and freezing the water at a sublimation temperature of 195° K. (−78° C.). The increase of the amount of dry ice by 0.5 kg, for instance, compensates the heat losses by the external walls of the chamber 1 and causes further cooling of the frozen water. Consequently, the required heat of sublimation from the environment is mainly taken from the water. The super-cooled frozen water acts as low-temperature storage medium for the adjacent chillroom and absorbs heat from the latter.

The storage of cold emanating from the dry ice takes place at a temperature higher than the sublimation temperature of dry ice which, in turn, depends on the partial pressure. After this shift of the potential difference between dry ice/low-temperature storage medium temperature levels there is a small temperature gradient from the low-temperature storage medium to the environment so that ultimately the requirement of refrigerant in this device is lower than without the use of a storage medium.

In FIG. 2 of the drawing, a modification of the embodiment of the device of FIG. 1 is shown in the form of a trolley for vending beverages. Beneath the fixedly installed trough *7a* a drawer 10 is arranged in a compartment 9 for making ice cubes therein which, after a predetermined refrigerating period, are dispensed with the beverages.

For the storage effect the entire assembly, namely trough *7a* with liquid medium and the water-filled drawer or drawers 10 therebeneath, has to be regarded as storage means.

The example of the device illustrated in FIG. 2 of the drawing shows the device installed in the upper portion of a refrigerated trolley. The device may also be provided vertically in the side walls of a refrigerated container, or it may be arranged between stacked goods to be cooled; in the latter case, storage means of predetermined thermal capacity are used which surround the refrigerant from all sides.

What is claimed is:

1. A container for refrigerating goods comprising an enclosed interior space subdivided by partition walls into a plurality of compartments which include one refrigerant compartment adapted to be charged with dry ice refrigerant and at least one chillroom compartment adapted for the containment of the goods to be refrigerated, the refrigerant compartment communicating with the chillroom compartment by openings which allow evaporating carbon dioxide from the dry ice to enter the chillroom compartment, and storage means of water located between the refrigerant compartment and the chillroom compartment in a sufficient quantity that at the beginning of the evaporation of the dry ice, the temperature in the chillroom compartment does not become substantially below −78° C.

2. A refrigerated container according to claim 1 wherein the openings are provided by a perforated plate supporting the refrigerant.

3. A refrigerated container according to claim 1 wherein the chillroom compartment includes a drawer adjacent to the storage means.

4. A means for refrigerating goods in refrigerated containers comprising providing a container including a refrigerant compartment adapted to contain dry ice and a chillroom compartment adapted for the storage of the goods to be refrigerated, the refrigerant compartment communicating with the chillroom compartment by openings which allow evaporating carbon dioxide from the dry ice to enter the chillroom compartment, and placing dry ice in the refrigerant compartment and a sufficient quantity of water between the refrigerant compartment and the chillroom compartment such that at the beginning of the evaporation of the dry ice, the temperature in the chillroom compartment does not become substantially below about −78° C.

* * * * *

UNITED STATES PATENT OFFICE

CERTIFICATE OF CORRECTION

PATENT NO. : 4,206,616

DATED : June 10, 1980

INVENTOR(S) : Martin Alfred Frank and Gerd Braun

It is certified that error appears in the above-identified patent and that said Letters Patent are hereby corrected as shown below:

On the title page the following should be added:

[30] FOREIGN APPLICATION PRIORITY DATA

July 14, 1977 Fed. Rep. of Germany 27 31 858

Signed and Sealed this

*Eighteenth* Day of *November 1980*

[SEAL]

*Attest:*

SIDNEY A. DIAMOND

*Attesting Officer*

*Commissioner of Patents and Trademarks*